US007980675B2

(12) United States Patent
Suzuki et al.

(10) Patent No.: US 7,980,675 B2
(45) Date of Patent: Jul. 19, 2011

(54) INK JET HEAD

(75) Inventors: Takumi Suzuki, Yokohama (JP); Masahiko Kubota, Tokyo (JP); Tamaki Sato, Kawasaki (JP); Maki Kato, Kawasaki (JP); Kazuhiro Asai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 877 days.

(21) Appl. No.: 11/908,060

(22) PCT Filed: May 2, 2007

(86) PCT No.: PCT/JP2007/059804

§ 371 (c)(1),
(2), (4) Date: Sep. 7, 2007

(87) PCT Pub. No.: WO2007/129764

PCT Pub. Date: Nov. 15, 2007

(65) Prior Publication Data

US 2009/0267997 A1 Oct. 29, 2009

(30) Foreign Application Priority Data

May 2, 2006 (JP) ..... 2006-128399

(51) Int. Cl.
*B41J 2/05* (2006.01)

(52) U.S. Cl. ..... 347/65

(58) Field of Classification Search ..... 347/65
See application file for complete search history.

(56) References Cited

U.S. PATENT DOCUMENTS

| | | | | |
|---|---|---|---|---|
| 5,508,725 | A | 4/1996 | Goto et al. | 347/65 |
| 5,793,393 | A * | 8/1998 | Coven | 347/65 |
| 6,241,335 | B1 | 6/2001 | Suzuki | |
| 6,305,791 | B1 | 10/2001 | Hotomi et al. | 347/70 |
| 6,464,342 | B1 | 10/2002 | Kubota et al. | |
| 6,472,125 | B1 | 10/2002 | Koide et al. | |
| 6,508,538 | B2 | 1/2003 | Suzuki et al. | |
| 6,540,330 | B1 | 4/2003 | Kubota et al. | |
| 6,561,632 | B2 | 5/2003 | Feinn et al. | 347/65 |
| 6,663,229 | B2 | 12/2003 | Komuro et al. | |
| 6,910,760 | B2 | 6/2005 | Kubota et al. | |
| 6,960,424 | B2 | 11/2005 | Miyagawa et al. | |
| 2002/0063752 | A1 | 5/2002 | Clark | |
| 2006/0114295 | A1 | 6/2006 | Asai et al. | |
| 2006/0277755 | A1 | 12/2006 | Kubota et al. | |
| 2007/0252872 | A1 | 11/2007 | Fujii et al. | |

FOREIGN PATENT DOCUMENTS

| | | |
|---|---|---|
| CN | 1485206 A | 3/2004 |
| CN | 1732086 A | 2/2006 |
| EP | 1 264 694 | 12/2002 |
| EP | 1 380 419 | 1/2004 |
| JP | 10-235855 | 9/1998 |

* cited by examiner

*Primary Examiner* — Mark A Robinson
*Assistant Examiner* — Erin D Chiem
(74) *Attorney, Agent, or Firm* — Fitzpatrick, Cella, Harper & Scinto

(57) ABSTRACT

An ink jet head includes a substrate having an ink supply port, an ejection outlet for ejecting ink supplied through the supply port, and a flow path portion which provides fluid communication between the supply port and the ejection outlet. The flow path portion includes a near portion which is near to the substrate and a remote portion which is remote from the substrate, and a width of the near portion is different from a width of the remote portion in a sectional plane perpendicular to a direction of flow of the ink, and a stepped portion is provided between the near portion and the remote portion.

7 Claims, 8 Drawing Sheets

INK JET HEAD

TECHNICAL FIELD

The present invention relates to an ink jet head, in particular, the structure of the ink passages in an ink jet head, which guide ink from the common ink reserve chamber of an ink jet head to the ink jetting nozzles of the ink jet head.

TECHNICAL FIELD

An ink jet head has ink passages which guide ink from the common ink reserve chamber of the ink jet head to the ink jetting nozzles of the ink jet head. In a conventional ink jet head (ink jet head in accordance with prior art), all the ink passages are the same in height (Japanese Laid-open Patent Application 10-235855). Thus, if a conventional ink jet head is structured so that its ink jetting nozzles are arranged in a nonlinear fashion, for example, in a staggered pattern, in terms of the direction in which the nozzles are arranged, the ink passages become different in length. This difference in the ink passage length sometimes derogatorily affects the ink jetting performance of the ink jet head, and/or makes the adjacent two ink jetting nozzles different in the amount of ink they jet. Therefore, a conventional ink jet head needed to be structured so that each of its ink passages became optimal in flow resistance for making all the ink jetting nozzles equal in ink jetting performance.

In recent years, an ink jet printer has begun to be used to print a photographic image, and therefore, an ink jet head has been continuously increased in the density of its ink jetting nozzles, while the surface of the ink jet head, which has the openings of the nozzles remained limited in size. Thus, in order to make multiple ink passages, such as those described above, equal in flow resistance, an ink jet head has come to be structured so that the ink passages are made different in cross section; when they were kept the same in height, they were made different in width.

In order to make different in width the ink passages which are directly in connection to the ink jetting nozzles, one for one, which are arranged in high density, it is necessary to reduce in thickness (dimension in terms of direction in which ink jetting nozzles are aligned) the walls of the ink passages (FIGS. 11-14). Reducing the walls of the ink passages in thickness reduces in size the contact area between each wall, and the substrate on which the ink passages are formed, making it therefore possible that as the walls are subjected to the pressure for jetting ink, the walls will become separated from the substrate, and the separation of the walls of a given ink jetting nozzle will cause the adjacent ink jetting nozzles to reduce in ink jetting pressure.

The solution to the above described problem is to limit the width of each ink passage in order to keep the lateral walls of each ink passage thick enough to withstand the pressure generated for jetting ink, and increase the height of each ink passage in order to compensate for the limitation in the width. This solution, however, creates the following problem. That is, because each ink passage is directly connected to the corresponding ink jetting nozzle, increasing the ink passage in height increases the distance between the opening of the corresponding ink jetting nozzle and the means (energy generating element) for jetting ink, and the increase in this distance changes the amount by which ink is jetted from the ink jetting nozzle. Therefore, in order to make all the ink jetting nozzles of an ink jet head equal in the amount by which they jet ink, by making the longer ink passages greater in height than the shorter ink passages, it is necessary to make an adjustment by reducing in thickness the orifice plate (member which makes up lateral wall of ink jetting nozzle and lateral and top walls of ink passage). However, the change in the thickness of the orifice plate affects the strength of the orifice plate. Thus, if an orifice plate happens to be formed of resin, it suffers from the problem that if it is kept in contact with ink for a long time, it deforms (swells). As one of the examples of the technological solutions to this problem, there is an ink jet head disclosed in U.S. Pat. No. 6,561,632. Referring to FIG. 15, in the case of this ink jet head, ink passages 101 and 102, which are different in length, are matched in ink flow resistance by making them different in cross-sectional size by making them different in width. This setup, however, suffers from the problem that it does not work unless each ink passage is provided with its own ink reserve chamber. This creates a problem related to ink jet head manufacture; unless the substrate, in which the ink inlets are formed, is reduced in thickness, it is impossible to accurately form in shape multiple ink reserve chambers, one for each ink passage.

Further, referring to FIG. 16, in the case of an ink jet head in which the adjacent two ink passages are the same in the distance from the ink reserve chamber, but the corresponding ink jetting nozzles are different in cross-sectional size, being therefore different in the amount by which they jet ink, the ink passage connected to the ink jetting nozzle which is greater in the amount by which ink is jetted must be greater in width, because it must supply the ink jetting nozzle with a greater amount of ink than the amount of ink supplied to the ink jetting nozzle connected to the other ink passage. This creates the following problem. That is, in the case of an ink jet head whose ink passages are juxtaposed in high density, in order to increase, in width, the ink passage connected to the ink jetting nozzle greater in the amount by which ink is jetted, the ink passage connected to the ink jetting nozzle which is smaller in the amount by which ink is jetted must be reduced in width. This creates the problem that a narrower ink passage sometimes fails to supply the corresponding ink jetting nozzle with a sufficient amount of ink; that is, it sometimes falls short in ink refill frequency. Further, in the case of the ink jet head design, shown in FIG. 16, in which the ink passages which are connected, one for one, to the ink jetting nozzles which are smaller in the amount by which they jet ink are narrower than the ink passages which are connected, one for one, to the ink jetting nozzles which are greater in the amount by which they jet ink, it cannot be ensured that the walls of the ink passages are satisfactorily thick. In order to deal with this problem, the ink passages must be limited in width, making it difficult to provide a reliable ink jet printer whose ink jetting nozzles are arranged in high density.

DISCLOSURE OF THE INVENTION

The present invention was made in consideration of the problems described above, and therefore, the primary object of the present invention is to provide a structural arrangement for an ink passage, which makes it possible to provide an ink jet head which is satisfactory in the thickness of the lateral walls of each of its ink passages, and the ink passages of which are proper in ink flow resistance in that the ink flow resistance of each ink passage matches the amount by which ink is jetted by the corresponding ink jetting nozzle. Another object of the present invention is to provide a method for manufacturing an ink jet head having the above described structure. In other words, the primary object of the present invention is to provide such a structural arrangement for an ink jet head that can solve the above described problems for an ink jet head in which the adjacent two ink passages are different in the amount by which ink is jetted by the ink jetting nozzles which are directly in connection with the two ink passages one for one, and an ink jet head in which the adjacent two ink passages are different in length, that is, the distance from the ink reserve chamber to the ink jetting nozzle.

According to an aspect of the present invention, an ink jet head comprises a substrate having an ink supply port; an ejection outlet for ejecting ink supplied through said supply port; and a flow path portion which provides fluid communication between said supply port and said ejection outlet; wherein said flow path portion includes a near portion which is near to said substrate and a remote portion which is remote from said substrate, and a width of the near portion is different from a width of the remote portion in a sectional plane perpendicular to a direction of flow of the ink, and wherein a stepped portion is provided between the near portion and the remote portion.

The following preferred embodiments of the present invention make it possible to match the flow resistance of each of the ink passages of an ink jet head, in which the adjacent two ink jetting nozzles are different in the amount by which they jet ink, or an ink jet head in which the adjacent two ink passages are different in length, to the characteristic (amount by which ink jetting nozzle jets ink) of the ink jetting nozzle which is directly in connection with the ink passage. Therefore, they make it possible to provide a reliably ink jet head whose ink passages are arranged in high density. In other words, they make it possible to provide an ink jet head in which not only does the flow resistance of each ink passage match the length of the ink passage and the amount by which ink is jetted by the ink jetting nozzle which is directly in connection with the ink passage, but also, the lateral walls of each ink nozzle are thick enough to withstand the pressure generated for jetting ink.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention will be described with reference to the appended drawings. The following preferred embodiments of the present invention will be described with reference to ink jet heads which employ the recording method which causes ink to be jetted in the form of an ink droplet, using the energy from the bubbles generated in ink by heating the ink. However, the embodiments are not intended to limit the present invention in scope.

Embodiment 1

Figure 1:
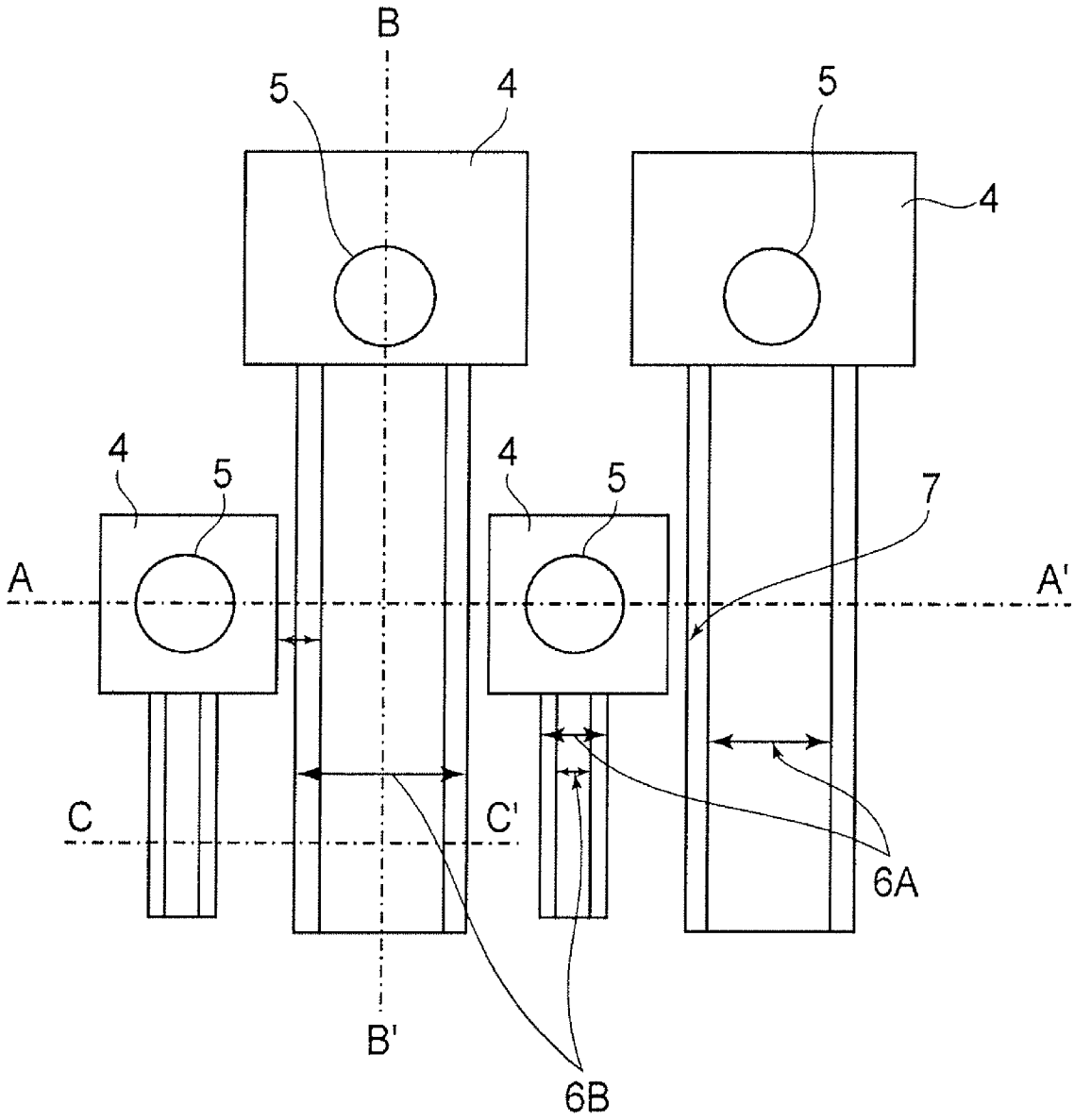
FIG. 1 is a phantom plan view of the ink jet head in the first embodiment of the present invention, showing the ink jetting nozzles and ink passages of the ink jet head.
Figure 2:
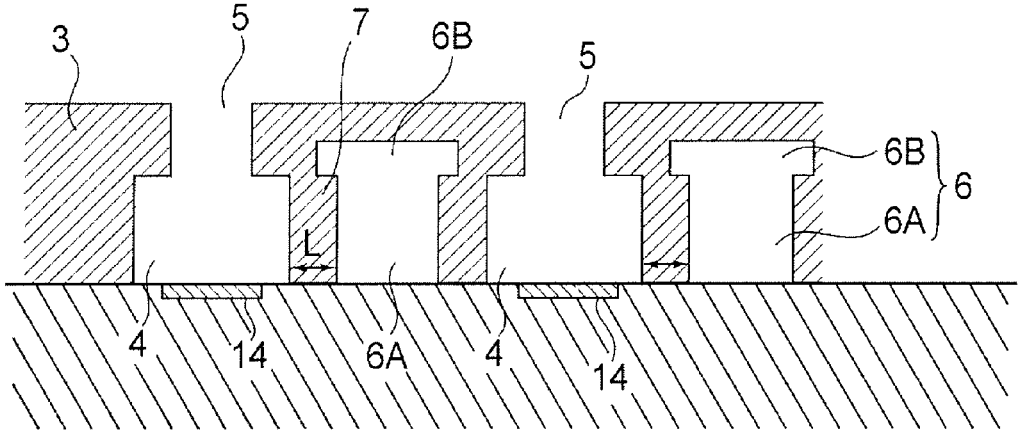
FIG. 2 is a sectional view of the ink jet head in FIG. 1, at a plane A-A' in FIG. 1.
Figure 3:
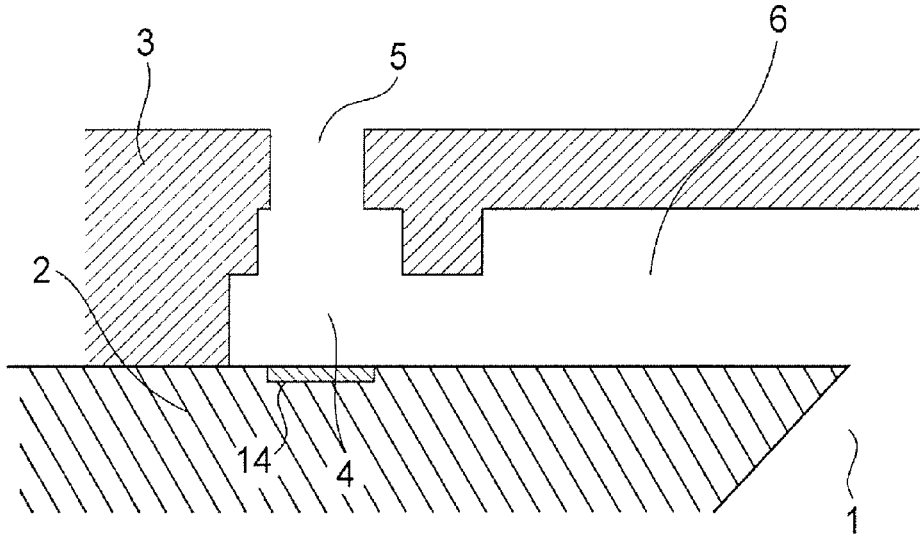
FIG. 3 is a sectional view of the ink jet head in FIG. 1, at a plane B-B' in FIG. 1.
Figure 4:
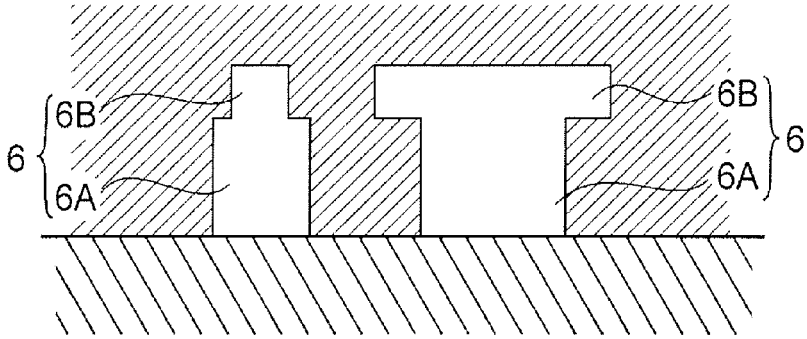
FIG. 4 is a sectional view of the ink jet head in FIG. 1, at a plane C-C' in FIG. 1.

FIG. 1 is a phantom plan view of the ink jet head in the first embodiment of the present invention, and shows the ink jetting nozzles and corresponding ink passages of the ink jet head. FIG. 2 is a sectional view of the ink jet head in FIG. 1, at a plane A-A' (which is perpendicular to ink delivery direction) in FIG. 1, and FIG. 3 is a sectional view of the ink jet head in FIG. 1, at a plane B-B' (which is parallel to ink delivery direction) in FIG. 1. FIG. 4 is a sectional view of the ink jet head in FIG. 1, at a plane C-C' (which is perpendicular to in delivery direction) in FIG. 1.

Referring to FIGS. 1-4, the ink jet head in this embodiment has: multiple energy generating elements 14 (heaters) as energy generating means; a substrate 2 which has a reserve ink chamber 1; and a plate 3 (which sometimes is referred to as orifice plate) for forming ink passages by being bonded to the top surface of the substrate 2. The ink passage formation plate 3 is a member for forming: multiple bubble generation chambers 4 (liquid chamber), in which the heaters are located, one for one; multiple ink jetting nozzles 5 which are connected to the bubble formation chambers 4, one for one, and through which recording liquid droplets (liquid ink droplets) are jetted; and multiple ink passages 6 which connect the reserve ink chamber 1 and bubble formation chambers 4, one for one. Referring to FIG. 1, the ink jet head is structured so that the bubble generation chambers, in which the heaters are located, and the ink jetting nozzles 5, are arranged in a staggered pattern. More specifically, the ink jet head in this embodiment has multiple relatively longer ink passages and multiple relatively shorter ink passages, and they are arranged so that a longer ink passage and a short ink passage are alternately positioned in terms of the direction perpendicular to the ink passages.

FIG. 1 shows four bubble formation chambers 4, which are in connected with the four ink jetting nozzles 5, one for one. However, a real ink jet head has far more than four bubble formation chambers 4, which are arranged in a staggered pattern, in the horizontal direction of the drawing. Although not shown in FIG. 1, the reserve ink chamber 1 is on the opposite side of the ink passages 6 from the ink jetting nozzles 5. The opening of the reserve ink chamber 1 is long and narrow on the ink passage side, and extends in the direction roughly parallel to the line A-A' in FIG. 1.

Each ink passage 6 in this embodiment has the so-called double-decker structure; it is made up of a first portion 6A which is in contact with the top surface of the substrate 2 and can be considered relatively near to the substrate 2, and a second portion 6B which is on top of the first portion 6A and can be considered relatively remote from the substrate 2.

Further, the bubble formation chambers 4, which lead to the ink jetting nozzles 5, one for one, through the corresponding ink passages 6, are arranged in the staggered pattern. Thus, the adjacent two ink passages 6 are different in length. Generally, the longer ink passage 6 (which hereafter will be referred to as long ink passage) is greater in flow resistance than the shorter ink passage 6 (which hereafter will be referred to as short ink passage). Thus, in order to equalize the adjacent two ink passages, which are different in length, in the amount by which ink is jetted from the ink jetting nozzle connected thereto, and also, in the length of time necessary to be refilled, the long ink passage needs to be greater in cross section than the short ink passage.

In this embodiment, therefore, of the adjacent two ink passages 6, the first portion 6A of the long ink passage 6 is rendered as wide as possible within the range in which it is possible to provide a preset distance of L between the first portion 6A of the long ink passage 6, and the bubble generation chamber 4 which is in connection with the short ink passage (FIG. 2). More specifically, the width of the first portion 6A of the long ink passage in this embodiment is 8 μm. The preset distance L (width) is such a distance that is necessary for the lateral walls 7 of each ink passage to be thick enough to provide, between the lateral walls 7 and substrate 2, a contact area large enough to prevent the lateral walls 7 from being separated from the substrate 2 by the pressure generated for jetting ink. Further, if the widening of the first portion 6A of the long ink passage is not enough to make the long ink passage as large in cross section as desired, the second portion 6B of the long ink passage, which is on top of the portion 6A of the long ink passage is widened to compensate the long ink passage for the difference between the desired size and the size achievable by the widening of the first portion 6A.

More specifically, referring to FIG. 4, the adjacent two ink passages, that is, one short ink passage and one long ink passage, are the same in the heights of the portions 6A and 6B. However, the width of the first portion 6A of the long ink passage is greater than the width of the first portion 6A of the short ink passage, and the width of the second portion 6B of the long ink passage is greater than the width of the first portion 6A of the same long ink passage. Incidentally, in this embodiment, the width of the second portion 6B of the short ink passage is less than the first portion 6A of the same short ink passage. In other words, the relatively long ink passage is wider on the opposite (or remote) side from the substrate than on the substrate (or near) side, whereas the relatively shorter ink passage is narrower on the opposite (remote) side from the substrate 2 than on the substrate (near) side. Also in this embodiment, there is a step at the border between the first and second portions 6A and 6B of each ink passage. The employment of this structural arrangement can provide each ink passage with sufficient strength, and ensures that even if ink passages are arranged in high density, the lateral walls of each ink passage remain adhered to the substrate 2. Further, in this embodiment, the ink jet head is structured so that the lateral walls of the first and second portions 6A and 6B of each ink passage are perpendicular to the substrate 2. However, this structural arrangement is not intended to limit the present invention in scope. That is, the present invention is applicable to an ink jet head in which the lateral walls of ink passages are tilted relative to the substrate, just as effectively as it is to an ink jet head in which the lateral walls of ink passages are perpendicular to the substrate. In the case of such an ink jet head, the lateral walls of each ink passage are desired to be tilted so that the greater the distance from the substrate, the smaller the width of each ink passage, in consideration of the ink delivery efficiency.

Figure 5:
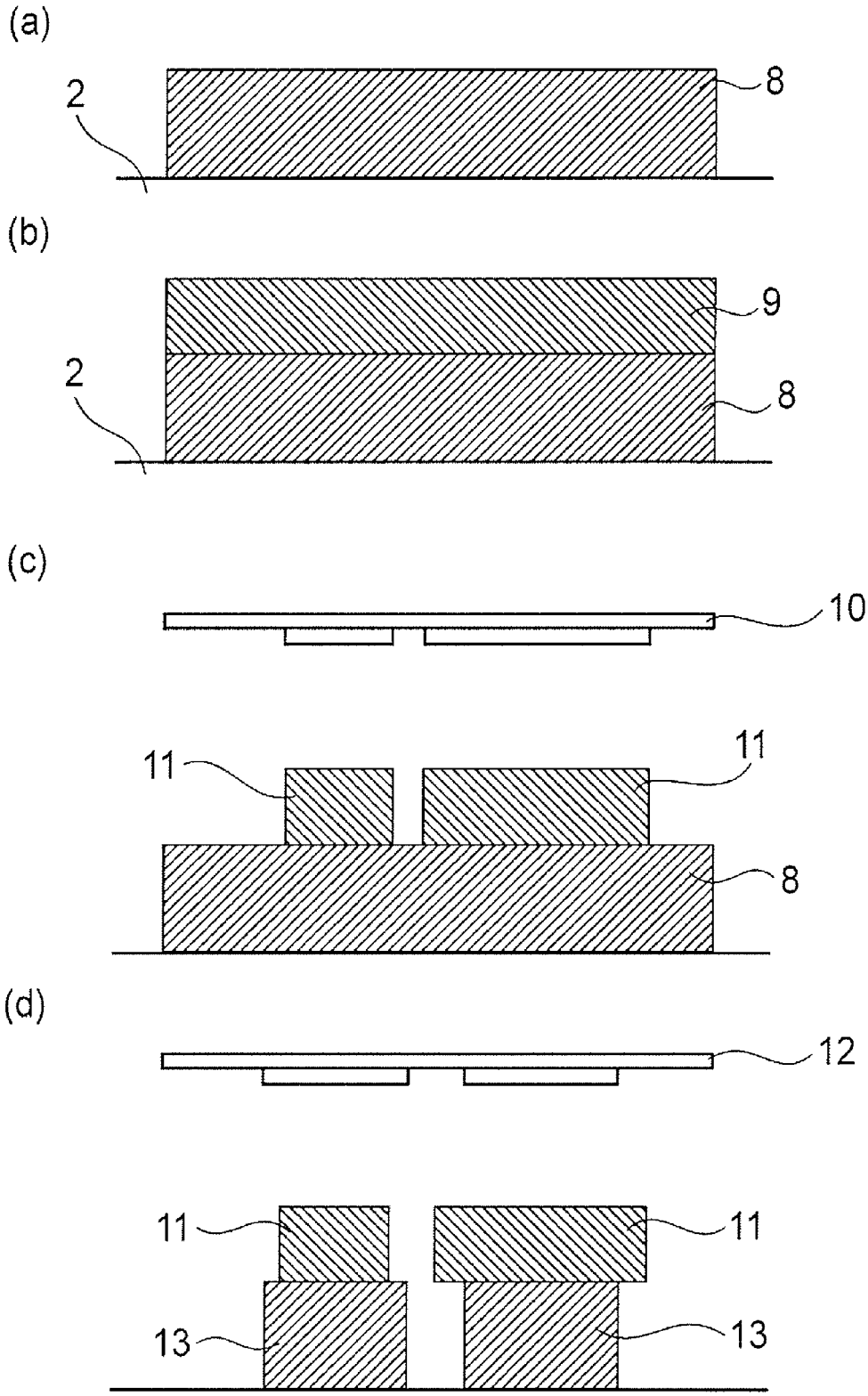
FIGS. 5(*a*)-5(*d*) are sectional views of the molds for the adjacent two ink passage portions of the ink jet head in the first embodiment of the present invention, in the various stages of the manufacturing of the ink passages of the ink jet head.

Next, the method for manufacturing the ink jet head in this embodiment, in particular, the ink passage portion of the ink jet head, will be described with reference to adjacent two ink passages. FIGS. 5(*a*)-5(*d*) are sectional views of the molds for the adjacent two ink passages in the ink jet head in the first embodiment of the present invention, in the various stages of the manufacturing of the ink passages of the ink jet head.

First, referring to FIG. 5(*a*), a layer 8 for forming the molds 13 for the first portions 6A of ink passages was formed on the substrate 2, on which the heaters (unshown), and the semiconductor circuit for supplying the heaters with electric power, are present, by coating the substrate 2 with the material for the layer 8. As the material for the layer 8 (molds 13), ODUR1010 (product of Tokyo Ooka Kogyo, Co., Ltd.) was used. The thickness of the layer 8 was 14 μm.

Next, referring to FIG. 5(*b*), a layer 9 for forming the molds 11 for the second portions 6B of the ink passages was formed on the layer 8 by coating the layer 8 with the material for the layer 9. As the material for the layer 9 (molds 11), PMMA (polymethyl methacrylate) was used. The thickness of the layer 9 was 5 μm.

Next, referring to FIG. 5(*c*), the layer 9 was exposed with the use of a mask 10 having the pattern for forming the molds 11 (FIG. 4), using a photolithographic method, and was developed, forming the molds 11 for the second portions 6B of the ink passages. During this step, the light used for exposing the layer 9 was filtered to remove the wavelength range used for exposing the layer 8. Further, in order to prevent the molds 11 from being dissolved during the development of the layer 8 for forming the first portions 6A of the ink passages, which was carried out later, the molds 11 were heated at 150° C.

Next, referring to FIG. 5(*d*), the layer 8 for forming the molds 13 for the first portions 6A of the ink passages, was exposed with the use of a mask 12 having the pattern for forming the molds 13 (FIG. 4) for the first portions 6A of the ink passages, using a photolithographic method, and was developed, forming the molds 13 for the first portions 6A of the ink passages. During this step, the light used for exposing the layer 8 was filtered to remove the wavelength range used for exposing the layer 9.

Then, a material for forming an ink passage formation member 3 was coated on the substrate 2 (including molds 11 and 13), and ink jetting nozzles 5 were formed by patterning, while protecting the surface of the ink passage formation member 3, by the photolithographic method (unshown). Then, the reserve ink chamber 1 was formed in the ink passage formation member 3 by etching the ink passage formation member 3, from the back side of the ink passage formation member 3. Then, the protective film on the ink passage formation member 3 was removed. Then, the molds 13 for the first portions 6A of the ink passages, and the molds 11 for the second portions 6B of the ink passages, were removed. Then, the ink passage formation member 3 was completely hardened. Lastly, the substrate 2 was diced to yield multiple individual ink jet heads, ending the process for manufacturing the ink jet head in accordance with the present invention.

Embodiment 2

Figure 6:
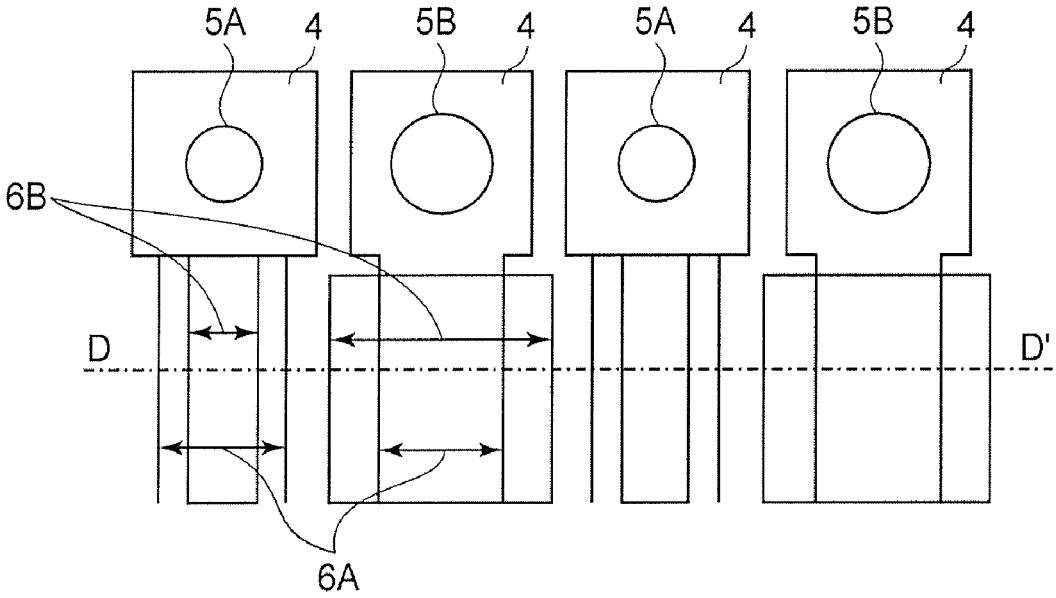
FIG. 6 is a phantom plan view of the ink jet head in the second embodiment of the present invention, showing the openings of the ink jetting nozzles of the ink jet head, and the corresponding ink passages of the ink jet head.
Figure 7:
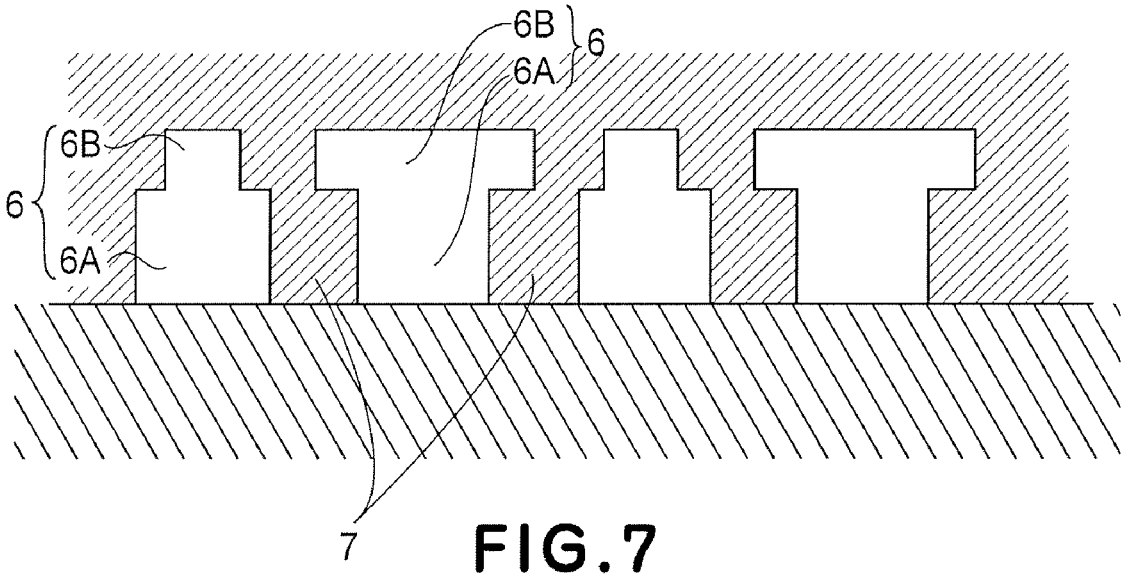
FIG. 7 is a sectional view of the ink jet head in FIG. 6, at a plane D-D' in FIG. 6.

FIG. 6 is a phantom plan view of the ink jet head in the second embodiment of the present invention, in particular, the ink jetting nozzles and corresponding ink passages of the ink jet head. FIG. 7 is a sectional view of the ink jet head in FIG. 6, at a plane D-D' in FIG. 6. In these drawings which are used for describing this embodiment, the structural components similar to those in the first embodiment are designated by the same referential symbols as those used for the counterparts in the first embodiment, and will not be described; only the structural arrangement and components which differentiate this embodiment from the first embodiment will be described.

Referring to FIGS. 6 and 7, in this embodiment, the bubble generation chambers 4, which are in connection to the corresponding ink jetting nozzles 5, are juxtaposed in a straight line parallel to the direction in which the ink jetting nozzles are arranged, and the adjacent two ink passages 6 are the same in length. However, the adjacent two ink jetting nozzles are different in the size of their opening. That is, the straight line of ink jetting nozzles includes ink jetting nozzles 5A, which are smaller in the size of their opening, and ink jetting nozzles 5B, which are larger in the size of their opening, and the ink jetting nozzles 5 are arranged so that nozzle 5A and nozzle 5B are alternately positioned in terms of the direction they are aligned. Obviously, the amount by which the ink jetting nozzle 5B jets ink is greater than the amount by which the ink jetting nozzle 5A jets ink. In other words, in this embodiment, the ink passage which is in connection to the larger ink jetting nozzle 5B is greater in width on the opposite side from the substrate than on the substrate side, whereas the ink passage which is in connection with the small ink jetting nozzle 5B is narrower on the opposite side from the substrate than on the substrate side.

Figure 16:
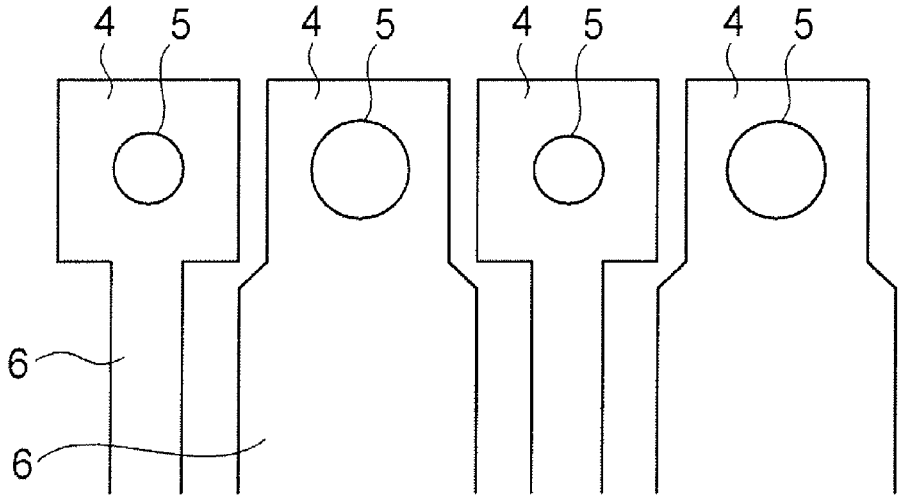
FIG. 16 is a drawing of a conventional ink jet head.

In the case of an ink jet head, such as the above described one, in order to supply the ink jetting nozzle which is larger in the amount by which it jets ink, with a sufficient amount of ink, the ink passage 6 in connection with this ink jetting nozzle must be wider, as shown in FIG. 16. Therefore, it occurs sometimes that in order to prevent the lateral walls of the ink passage from being rendered insufficient in thickness, the ink passage 6 which is in connection with the ink jetting nozzle 5A, which is smaller in the amount by which ink is jetted, must be reduced in width.

In this embodiment, therefore, as the countermeasure for the above described problem, the adjacent two ink passages are rendered the same in the width of the first portion 6A of the ink passage, but are rendered different in the width of the second portion 6B of the ink passage. More specifically, the portion 6B of the ink passage 6 connected to the ink jetting nozzle which is greater in the amount by which ink is jetted, is wider than the portion 6A of the same ink passage. Further, the width of the second portion 6B of the ink passage 6 which is connected to the ink jetting nozzle which is greater in the amount by which ink is jetted is wider than the second portion 6B of the ink passage 6 which is in connection to the ink jetting nozzle which is smaller in the amount by which ink is jetted. Moreover, the width of the second portion 6B of the ink passage 6 which is in connection to the ink jetting nozzle which is smaller in the amount by which ink is jetted is narrower than the first portion 6A of the same ink passage. Incidentally, the adjacent two ink passages are the same in the height of the portion 6A and the height of the portion 6B.

Constructing the second portions 6B as described above makes it possible to ensure that the lateral walls of each ink passage remain airtightly adhered to the substrate, and also, that the ink passage 6 which is in connection to the ink jetting nozzle 5A, which is smaller in the amount by which ink is jetted, is satisfactory in terms of refill frequency, even if ink passages are juxtaposed in high density. In addition, it is ensured that the ink passage which is in connection to the ink jetting nozzle which is greater in the amount by which ink is jetted is satisfactory in the amount by which ink flows through the ink passage. Therefore, the ink jet head in this embodiment is employable even by a high speed ink jet printer.

Figure 8:
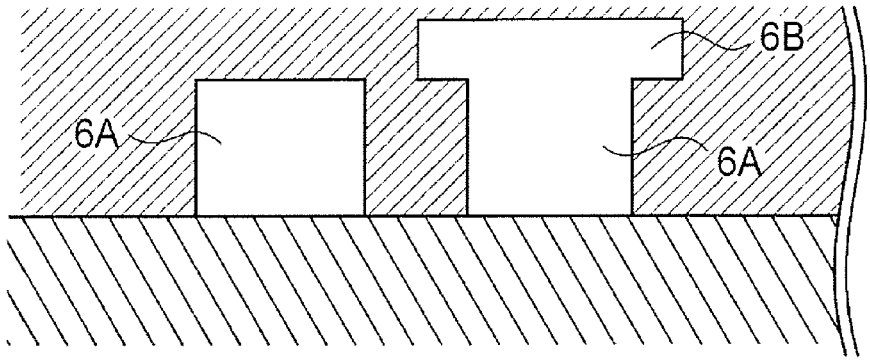
FIG. 8 is a schematic sectional view of one of the examples of the modification of the ink jet heat in the second embodiment.

Shown in FIG. 8 is a modified version of the ink jet head in this embodiment. FIG. 8 is a schematic sectional view of the adjacent two ink passages which are different in the amount by which ink is jetted by the corresponding ink jetting nozzles. In the case of the example shown in this drawing, the two ink passages 6 are the same in the width and height of the portion 6A, and only the ink passage 6 (ink passage on right-hand side in FIG. 8), which is greater in the amount by which ink is jetted by the corresponding ink jetting nozzle is provided with the second portion 6B, which is on top of the portion 6A. The present invention can also be applied to this modified version of the ink jet head shown in FIG. 8, just as effectively as it is to the ink jet head shown in FIGS. 6 and 7.

Embodiment 3

Figure 9:
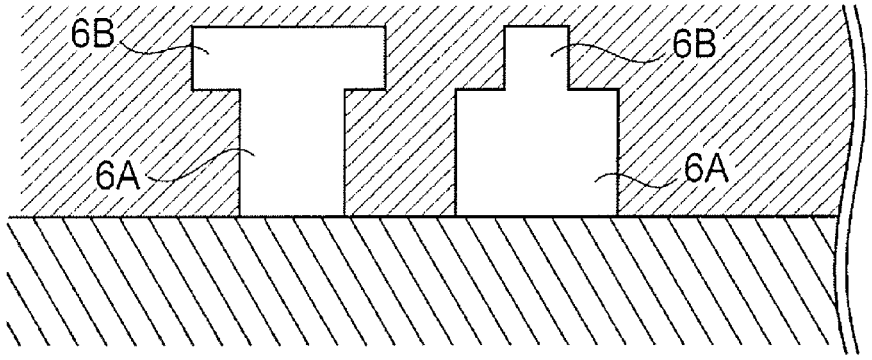
FIG. 9 is a schematic sectional view of the ink jet head in the third embodiment of the present invention, showing the adjacent two ink passages.

FIG. 9 is a schematic sectional view of the adjacent two ink passages in the ink jet head in the third embodiment of the present invention. In the drawing, the structural components which are the same as the counterparts in the first embodiment are designated with the same referential symbols as those used to describe the first embodiment, and this embodiment will be described primarily regarding the features which differentiate this embodiment from the preceding embodiments. FIG. 9 corresponds to a line C-C' in FIG. 1.

Referring to FIG. 9, in this embodiment, the adjacent two ink passages are different in the width of the first portion 6A; one is wider than the other. Further, the width of the second portion 6B of the ink passage whose first portion 6A is greater than that of the other ink passage is narrower than its first portion 6A. Further, the width of second portion 6B of the ink passage 6 whose first portion 6A is narrower than that of the other is wider than its first portion 6A. In terms of the heights of the first and second portions 6A and 6B, the two ink passages are the same.

This setup is effective in the case in which the bubble generation chambers, which lead to the ink jetting nozzles, one for one, are arranged in a staggered pattern, as in the case of an ink jet head which has the bubble generation chambers which are closer to the reserve ink chamber, and the bubble generation chambers which are farther from the reserve ink chamber. The merit of this embodiment is the same as that of the first embodiment in that both ensure that the lateral walls of each ink passage are thick enough to withstand the pressure for jetting ink. In particular, in the case of an ink jet head, shown in FIG. 3, in which the second portion of each ink passage does extend to the bubble generation chamber, the height of the first portion 6A of the ink passage determines the cross-sectional size of the ink passage at the point where the ink passage meets the bubble generation chamber. Therefore, the longer ink passage which must be greater in cross-sectional area than the shorter ink passage is rendered greater in the width of the first portion 6A than the shorter ink passage. For the loss in the cross-sectional area of the short ink passage, which results from this widening of the first portion 6A of the longer ink passage, a compensation is made by widening the second portion 6B of the short ink passage to reduce the short ink passage in flow resistance.

Embodiment 4

Figure 10:
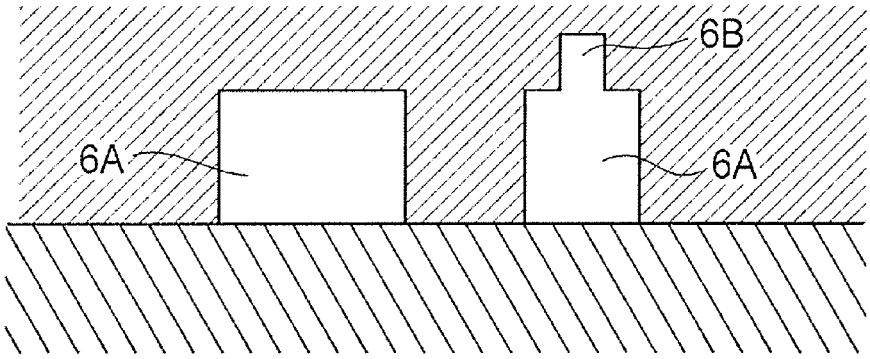
FIG. 10 is a schematic sectional view of the ink jet head in the fourth embodiment of the present invention, showing the adjacent two ink passages.
Figure 11:
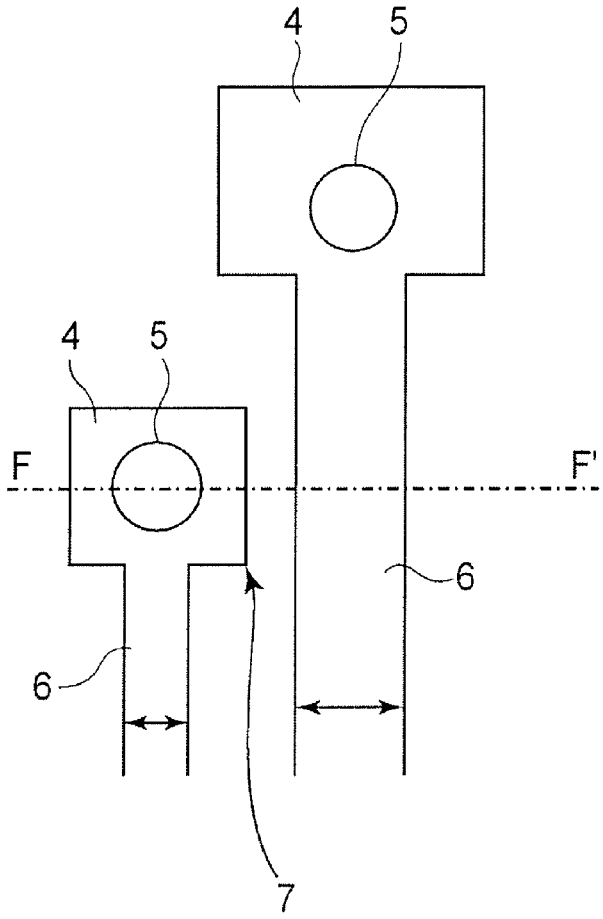
FIG. 11 is a plan view of a conventional ink jet head (ink jet in accordance with prior art), showing the adjacent two ink passages which are different in the length, and their adjacencies.
Figure 12:
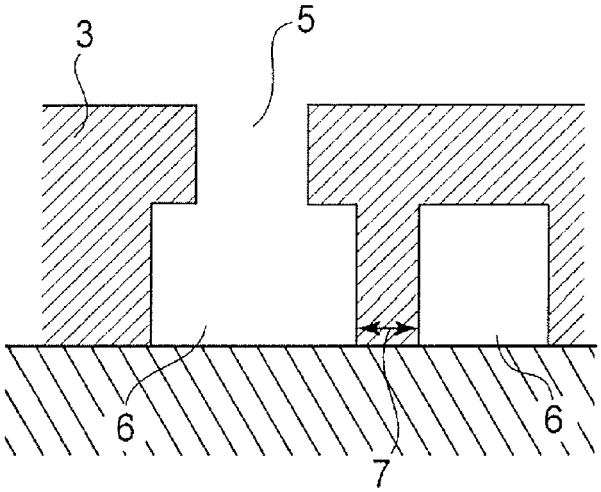
FIG. 12 is a sectional view of the ink jet head in FIG. 11, at a plane F-F' in FIG. 11.
Figure 13:
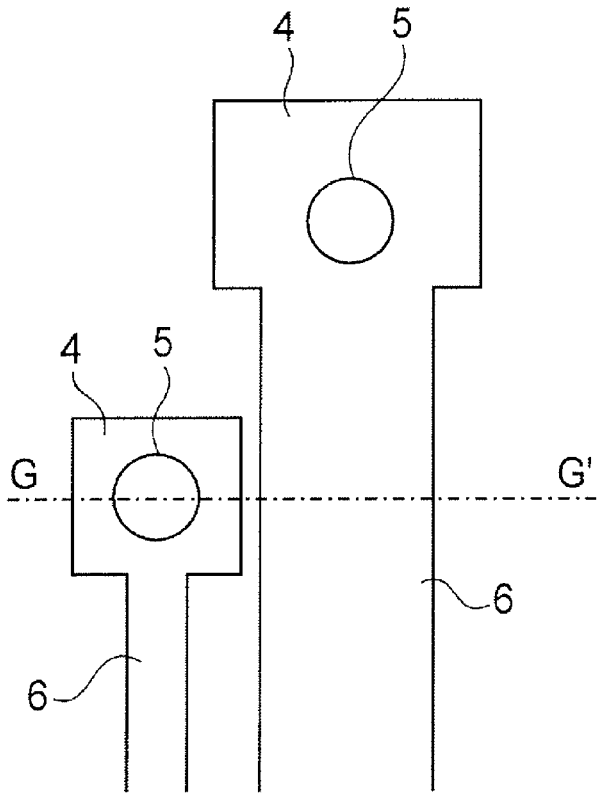
FIG. 13 is a phantom plan view of the conventional ink jet head.
Figure 14:
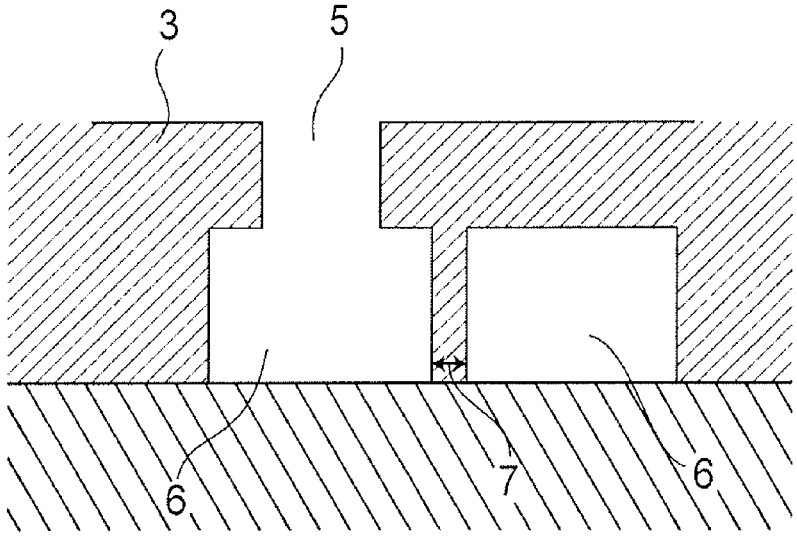
FIG. 14 is a sectional view of the ink jet head in FIG. 13, at a plane G-G' in FIG. 13.
Figure 15:
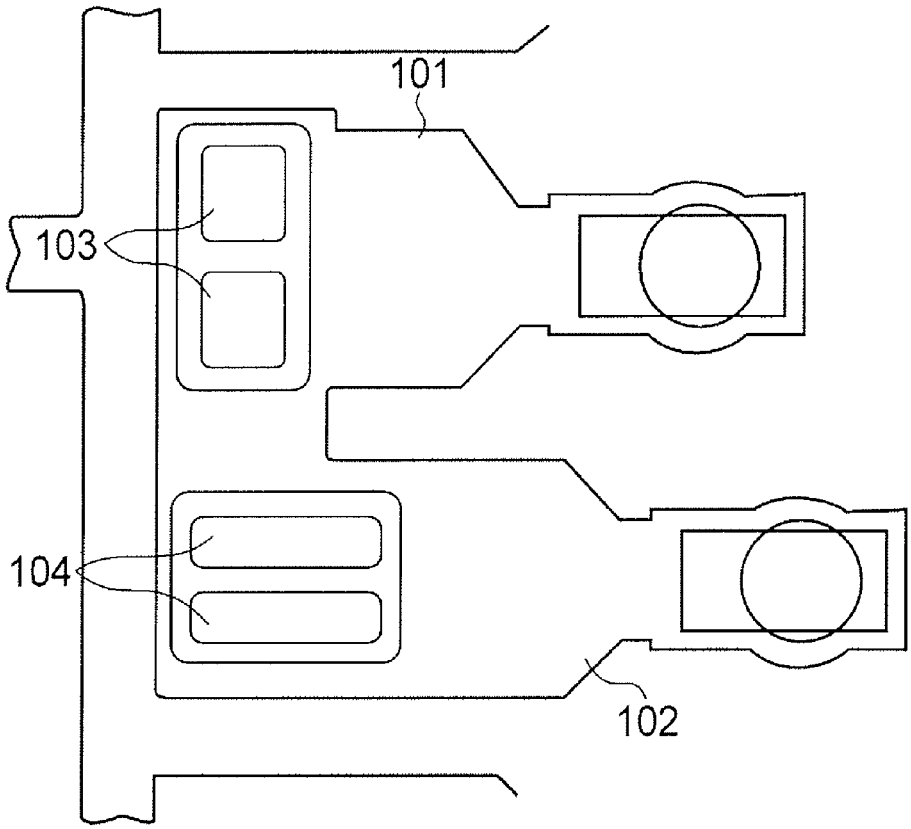
FIG. 15 is a drawing of a conventional ink jet head.

FIG. 10 is a schematic sectional view of the adjacent two ink passages in the ink jet head in the fourth embodiment of the present invention. In the drawing, the structural components which are the same as the counterparts in the first embodiment are designated with the same referential symbols as those used to describe the first embodiment, and this embodiment will be described primarily regarding the features which differentiate this embodiment from the preceding embodiments. FIG. 10 corresponds to a line C-C' in FIG. 1.

Referring to FIG. 10, in this embodiment, the adjacent two ink passages are different in the width of the first portion 6A; one is wider than the other. Further, only the ink passage 6 whose first portion 6A is narrower than that of the other is provided with the second portion 6B, which is on top of the portion 6A. Incidentally, the two ink passages are the same in the height of the first portion 6A.

This setup is effective for an ink jet head in which the bubble generation chambers, which lead to the ink jetting nozzles, one for one, are arranged in a staggered pattern, as in the case of an ink jet head which has the bubble generation chambers which are closer to the reserve ink chamber, and the bubble generation chambers which are farther from the reserve ink chamber. The merit of this embodiment is the same as that of the first embodiment in that both ensure that the lateral walls of each ink passage are thick enough to withstand the pressure for jetting ink. In particular, in the case of the ink jet head in this embodiment, the height of the first portion 6A of the ink passage determines the cross-sectional size of the ink passage at the point where the ink passage meets the bubble generation chamber 4, as in the third embodiment. Therefore, the longer ink passage which must be greater in cross-sectional area than the shorter ink passage is rendered greater in the width of the first portion 6A than the shorter ink passage. This widening of the first portion 6A of the long ink passage, which ensures that the long ink passage is satisfactory in terms of flow resistance, requires the adjacent short ink passage to be reduced in width, in order to compensate for the loss in the thickness of the lateral wall between the two ink passages. This makes the short ink passage unsatisfactory in terms of flow resistance; it does not allow the short ink passage to provide the corresponding ink jetting nozzle with a sufficient amount of ink. In order to deal with this situation, the short ink passage is provided with the second portion 6B. With the employment of the above described structural arrangement, even an ink jet head, in which the bubble generation chambers are arranged in a staggered pattern and the ink jetting nozzles are different in the amount by which they jet ink, can be designed so that each of its ink passages becomes optimal in flow resistance.

In this embodiment, the second portion 6B of the ink passage whose first portion 6A is narrower than that of the other is narrower than its first portion 6A. It is needless to say, however, that this embodiment is compatible with an ink jet head in which the second portion 6B, shown in FIG. 10, is wider than the first portion 6A (bottom portion), because if the second portion 6B is wider than the first portion 6A (bottom portion), the above described effect is exacerbated. Further, this embodiment is also compatible with an ink jet head structured so that the first portion 6A, that is, the portion under the second portion 6B, of an ink passage is wider than the first portion 6A of the adjacent ink passage.

Incidentally, the present invention is compatible with any of the combinations of the above described embodiments. Further, each of the preceding preferred embodiments was described with reference to the ink jet heads structured so that at least one of the adjacent two ink passages has the first portion (bottom portion) and second portion (top portion). However, the preceding embodiments are not intended to limit the present invention in scope. That is, the present invention is also applicable to an ink jet head whose ink passages have three or more levels.

INDUSTRIAL APPLICABILITY

As described hereinabove, according to the present invention, it is possible to match the flow resistance of each of the ink passages of an ink jet head, in which the adjacent two ink jetting nozzles are different in the amount by which they jet ink, or an ink jet head in which the adjacent two ink passages are different in length, to the characteristic (amount by which ink jetting nozzle jets ink) of the ink jetting nozzle which is directly in connection with the ink passage. Therefore, it is possible to provide a reliable ink jet head whose ink passages are arranged in high density. In other words, it is possible to provide an ink jet head in which not only does the flow resistance of each ink passage match the length of the ink passage and the amount by which ink is jetted by the ink jetting nozzle which is directly in connection with the ink passage, but also, the lateral walls of each ink nozzle are thick enough to withstand the pressure generated for jetting ink.

While the invention has been described with reference to the structures disclosed herein, it is not confined to the details set forth, and this application is intended to cover such modifications or changes as may come within the purposes of the improvements or the scope of the following claims.

The invention claimed is:

1. An ink jet head comprising:

a substrate having an energy generating element for generating energy for ejecting ink through an ejection outlet, and an ink supply port for supplying the ink to said ejection outlet;

a chamber portion with said energy generating element provided therein; and a flow path portion which provides fluid communication between said supply port and said chamber, wherein said flow path portion includes a near portion which is relatively near to said substrate with respect to a reference direction that is perpendicular to said substrate and parallel to a direction of flow of the ink from said chamber to said ejection outlet, and a remote portion which is relatively remote from said substrate with respect to the reference direction, and a width of the near portion is different from a width of the remote portion in a sectional plane perpendicular to the direction of flow of the ink in said flow path portion, and wherein a stepped portion is provided between the near portion and the remote portion.

2. An ink jet head according to claim 1, wherein the width of the remote portion is greater than the width of the near portion.

3. An ink jet head according to claim 1, wherein the width of the remote portion is less than the width of the near portion.

4. An ink jet head according to claim 1, comprising a plurality of ejection outlets and a plurality of flow path portions, wherein said flow path portions in which the width of the remote portion is greater than the width of the near portion, and said flow path portions in which the width of the remote portion is less than the width of the near portion are arranged alternately along a direction in which said ejection outlets are arranged.

5. An ink jet head according to claim 1, comprising a plurality of ejection outlets and a plurality of flow path portions, wherein said flow path portions in which the width of the near portion and the width of the remote portion are different from each other and said flow path portions in which the width of the near portion and the width of the remote portion are equal to each other are arranged alternately along a direction in which said ejection outlets are arranged.

6. An ink jet head according to claim 1, comprising a plurality of ejection outlets and a plurality of flow path portions, wherein said flow path portions have different lengths, and wherein in a relatively longer flow path portion, the width of the remote portion is greater than the width of the near portion, and in a relatively shorter flow path portion, the width of the remote portion is less than the width of the near portion, and wherein the relative longer flow path portions and the relative shorter flow path portions are arranged alternately along a direction in which said ejection outlets are arranged.

7. An ink jet head according to claim 1, comprising a plurality of ejection outlets and a plurality of flow path portions, wherein said ejection outlets have different opening areas, and wherein in the flow path portions which are in fluid communication with said ejection outlets having a relatively larger opening area, the width of the remote portion is greater than the width of the near portion, and in the flow path portions which are in fluid communication with said ejection outlets having a relatively smaller opening area, the width of the remote portion is less than the width of the near portion, and the flow path portions which are in fluid communication with said ejection outlets having the relatively larger opening area and the flow path portions which are in fluid communication with said ejection outlets having the relatively smaller opening area are arranged alternately along a direction in which said ejection outlets are arranged.

* * * * *